US006036454A

United States Patent [19]

Bianchi et al.

[11] Patent Number: 6,036,454

[45] Date of Patent: Mar. 14, 2000

[54] MOTOR-DRIVEN COMPRESSOR WITH REDUCED LATERAL DIMENSIONS

[75] Inventors: Vittorio Bianchi, Ferrera di Varese; Roberto Giraudo, Riva Presso Chieri; Marek Zgliczynski, Buttigliera Alta, all of Italy; Lilie Dietmar, Joinville, Brazil; Ingwald Vollrath, Joinville, Brazil; Marcio L. Todescat, Joinville, Brazil; Vincent Gurubatham, St. Joseph, Mich.

[73] Assignee: Embraco Europe S.r.l., Torino, Italy

[21] Appl. No.: 08/825,062

[22] PCT Filed: Jun. 7, 1995

[86] PCT No.: PCT/EP95/02176

§ 371 Date: Mar. 27, 1997

§ 102(e) Date: Mar. 27, 1997

[87] PCT Pub. No.: WO96/10131

PCT Pub. Date: Apr. 4, 1996

[30] Foreign Application Priority Data

Sep. 28, 1994 [IT] Italy ..... T094A0754

[51] Int. Cl.[7] ..... F04B 35/00

[52] U.S. Cl. ..... 417/415; 230/173

[58] Field of Search ..... 230/173, 58; 417/372, 417/312, 269, 415

[56] References Cited

U.S. PATENT DOCUMENTS 4,718,830 1/1988 Middleton et al. ..... 417/372

FOREIGN PATENT DOCUMENTS 1047406 12/1953 France .
719503 4/1942 Germany .
2436407 2/1976 Germany .
2179709 3/1987 United Kingdom .

*Primary Examiner*—Charles G. Freay
*Assistant Examiner*—Robert Z. Evora
*Attorney, Agent, or Firm*—Sughrue, Mion, Zinn, Macpeak & Seas, PLLC

[57] ABSTRACT

A motor-driven compressor comprises a drive shaft driven by an electric actuator and acting on a crank mechanism having a crank with which a connecting rod is associated eccentrically, the connecting rod supporting a piston movable in a corresponding cylinder. The cylinder has a longitudinal axis W inclined to the axis X of the drive shaft at an angle other than 90 n degrees so that the connecting rod supporting the piston has a longitudinal axis K which intersects the plane in which the crank lies.

8 Claims, 1 Drawing Sheet

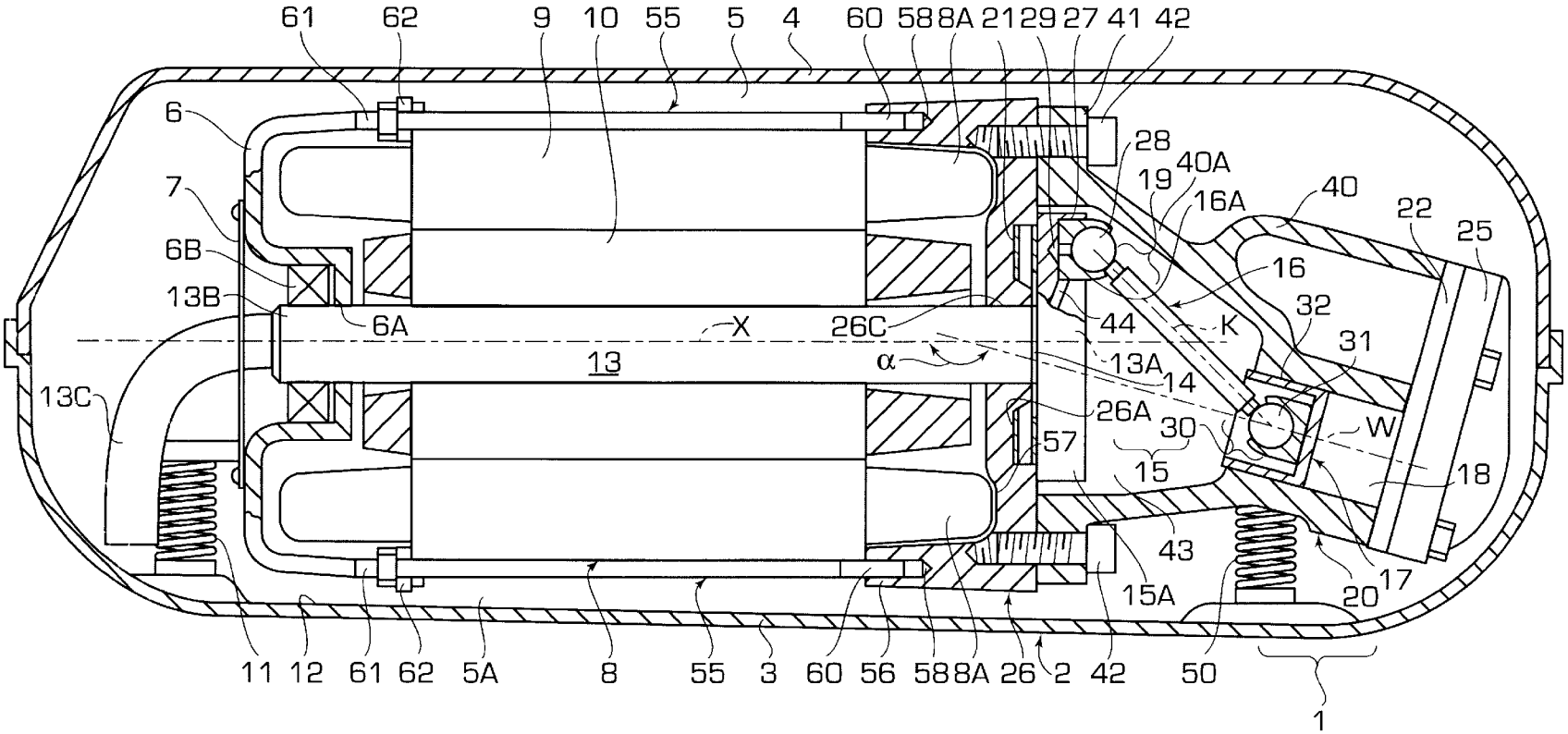
1
2
3
4
5
5A
6
6A
6B
7
8
9
10
11
12
13
13A
13B
13C
14
15
15A
16
16A
17
18
19
20
21
22
25
26
26A
26C
27
28
29
30
31
32
40
40A
41
42
43
44
50
55
56
57
58
58A
60
61
62
K
W
X
α

MOTOR-DRIVEN COMPRESSOR WITH REDUCED LATERAL DIMENSIONS

This application is a 371 of PCT/EP95/02176, filed Jun. 7, 1995.

BACKGROUND OF THE INVENTION

The present invention is directed to a motor-driven compressor comprises a drive shaft driven by an electric actuator and acting on a crank mechanism having a crank to which a connecting rod is eccentrically connected and the connecting rod is connected to a piston movable in a corresponding cylinder.

With particular reference to the field of refrigerators, a motor-driven compressor used in a domestic appliance of this type has a cylinder in which the respective piston moves, and which has a longitudinal axis generally perpendicular to the axis of the drive shaft. The latter is generally perpendicular to a surface supporting the refrigerator. The axis of the cylinder, in particular, lies in a plane containing the longitudinal axis of the connecting rod at each point of the stroke of the piston in the cylinder, the plane being parallel to that in which the crank lies.

This solution consequently involves a fairly large vertical dimension of the motor-driven compressor. As a result of this and in order not to have very hulky motor-driven compressors, the dimensions of the cylinder have to be kept within limited values. It is therefore impossible to increase the displacement of the motor-driven compressor beyond certain values, clearly involving problems which also adversely affect the flowrate per unit time of the coolant fluid circulating in the refrigerator circuit.

Moreover, known solutions require the various parts of the crank mechanism and the drive shaft to be formed with considerable precision in order to achieve the required perpendicularity between the longitudinal axis of the cylinder and the drive shaft. This is to prevent any jamming of the piston in the cylinder and of the connecting rod on the eccentric pin, which would clearly involve problems in the use of the compressor.

SUMMARY OF THE INVENTION

An object of the present invention is to produce a motor-driven compressor which does not have the disadvantages of known motor-driven compressors mentioned above.

A particular object of the invention is to produce a motor-driven compressor with reduced vertical dimensions to permit better positioning thereof, particularly in refrigerators.

Another object is to offer a range of motor-driven compressors of the type mentioned, having a plurality of displacements so as to permit greater versatility in use.

Yet another object is to offer a motor-driven compressor of the type mentioned which is easy to produce, reliable and of low cost.

A further object is to offer a range of motor-driven compressors of the type mentioned, having pistons which can move at variable speeds during the intake and compression stages in order to improve the thermodynamic performance of the compressors.

These and other objects which will become clear to an expert in the art are achieved by means of a motor-driven compressor according to the characterizing part of the main claim.

BRIEF DESCRIPTION OF THE DRAWINGS

The invention will be understood better from a reading of the description which follows with reference to the single appended drawing, given by way of non-limiting example and showing a cross-section of a motor-driven compressor according to a preferred embodiment of the invention.

DETAILED DESCRIPTION OF THE INVENTION

With reference to the drawing, a motor-driven compressor, indicated 1, comprises a casing 2 defined by two half-shells 3 and 4 coupled in any known manner. An electric motor 8 disposed in a cavity 5 defined by the casing 2 comprises a conventional stator 9 and a rotor 10. The motor is oblong and is supported, in any known manner, on spring shock-absorbers 11 (only one of which is visible in the drawing) which in turn are associated with a wall 12 of the half-shell 3.

The stator 9 is supported by a conventional support member disposed laterally on the motor 8 and carried in turn by an element 7 of known type fixed to the casing 2 in any known manner. The member 6 is drilled at 6A and supports a ball bearing 6B keyed to an output shaft (or drive shaft) 13 which is hollow, as indicated at 13A. The shaft 13 is thus guided laterally for rotation by the support member 6. A pipe 13C is connected to a lateral end 13B of the shaft 13 and opens in the lower portion 5A of the cavity 5. A crank mechanism 15 associated in known manner with the other, upper end 14 of the shaft 13, comprises a crank 15A and a connecting rod 16 acting on a conventional piston 17 movable in a cavity 18 of a cylinder 20 so as to compress a fluid, for example, a coolant fluid of a refrigerator in which the motor-driven compressor is used. At one end of this cavity there is a valve plate 22 having ducts (not shown) in which there are conventional valves. Finally, a compressor head 25 is disposed on the valve plate 22.

The crank 15A supports eccentrically a ball-and-socket joint 19 with which the small end of the connecting rod 16A is associated. The crank 15A bears on a roller thrust bearing 21 inserted in a corresponding seat 26A in a compressor body 26, in a through-hole 26C of which the shaft 13 is rotatably mounted. The ball-and-socket joint 19 comprises a conventional body 27 containing a ball 28 associated with the small end of the connecting rod 16A, the body 27 being disposed in a corresponding seat 29 formed eccentrically, as stated, in the crank 15A.

The piston 17 is associated with the connecting rod 16 by means of another ball-and-socket joint 30 comprising a ball 31 associated with the connecting rod 16 and inserted in a housing body 32 fixed inside the piston 17 in known manner. This body 32, like the body 27, is formed in known manner to permit the insertion of the corresponding ball therein.

The ball-and-socket joints 19 and 30 allow the connecting rod 16 to be arranged with an axis K which is inclined to the plane in which the crank 15A lies whatever the position of the piston 17 in the cylinder 20.

The cylinder 20 has a longitudinal axis W which is inclined to the axis X of the drive shaft 13 at an angle alpha ($\alpha$) other than 90°. By virtue of this arrangement, the motor-driven compressor has a relatively. large longitudinal dimension (in the direction of the axis X transverse with respect to a refrigerator in which it is disposed) but has very limited height (that is, in a plane which is perpendicular to the axis X and in which the refrigerator, mentioned above and not shown, is disposed). This facilitates its use in refrigerators in which a large height of the motor-driven compressor adversely affects the useful volume of the refrigerator compartment or of the freezer compartment of the domestic appliance.

The cylinder 20 is farmed, for example, by casting in the form of a body 40 having a flanged portion 41 connected to the compressor body 26 by screws 42. Below the cavity 18 in which the piston 17 moves, the cylinder body 40 has a further hollow region 43 in which the crank 15A and the connecting rod 16 move (about the axis X). The duct 13A in the shaft 13 opens into this cavity (which communicates with the cavity 5 of the casing 2 of the motor-driven compressor by means of holes (not shown) in a wall 40A of the body 40) and is connected with a lower region 5A of the cavity 5 by means of the pipe 13C. The fluid to be compressed which is present in the region 5A is drawn in from the pipe 13C into the cavity 43 by the movement of the crank mechanism 15 and of the shaft 13. The fluid is substantially atomized in the cavity 43 and acts as a lubricant for the movable members. In order to lubricate the ball-and-socket joint 19, a duct 44 connects the duct 13A inside the shaft 13 to the seat 29 in which this joint is disposed; the fluid mentioned above lubricates the joint 19 by means of this duct 44 to prevent jamming of the connecting rod 16 on the crank 15A. The joint 30, which connects the connecting rod 16 to the piston 17, on the other hand, is immersed in the lubricant "mist" which comes out of the duct 13A and is therefore lubricated directly thereby (like the piston 17 during its reciprocating motion in the cylinder 20).

The body 40 of the cylinder 20 is acted on by a compression spring 50 associated with the wall 12 of the half-shell 3, this spring withstanding and opposing the normal movements of the cylinder 20 when the motor-driven compressor 1 is in use.

Finally, conventional tie-rods 55 connect the compressor body 26 to the support member 6. This body has a suitable, essentially cup-like shape and has a side wall 56 which surrounds the upper portion of the motor, the stator poles 8A of which are partially housed with their ends nearest to the body 26 in corresponding seats 57 (or in a single annular seat) provided in the compressor body. Blind threaded holes 58 are formed in the side wall 56 for cooperating with ends 60 of the tie rods 55, the other ends 61 of which cooperate with fixing elements 62 fixed to the member 6.

As stated, the motor-driven compressor 1 has considerably reduced lateral (transverse) dimensions in comparison with known motor-driven compressors. Moreover, it is easy to produce and assemble and reliable in use.

A specific embodiment of the invention has been described. However, other embodiments, such as that in which the cylinder body is connected to the compressor body by means of discrete connecting elements which permit ample communication between the cavity 43 and the cavity 5 are possible; these other solutions are intended to fall within the scope of the present invention.

What is claimed is:

1. A motor-driven compressor (1) comprises a drive shaft (13) driven by an electric actuator (8) and acting on a crank mechanism (15) having a crank (15A) to which a connecting rod (16) is eccentrically connected, the connecting rod (16) is connected to a piston (17) movable in a corresponding cylinder (20), wherein the cylinder (20) has a longitudinal axis (W) inclined in a non-parallel relation to the axis (X) of the drive shaft (13) at an angle (a) other than 90°, and the connecting rod (16) connected to the piston (17) has a longitudinal axis (K) which intersects the plane in which the crank (15A) lies during at least part of the stroke of the piston (17) in the cylinder (20).

2. A motor-driven compressor according to claim 1, wherein the connecting rod (16) is connected to the piston (17) and to the crank (15A) by means of corresponding ball-and-socket joints (19, 30).

3. A motor-driven compressor according to claim 2, wherein the ball-and-socket joint (19) which cooperates with the small end of the connecting rod (16A) is associated with a seat (29) formed eccentrically in the crank (15A).

4. A motor-driven compressor according to claim 1, wherein the cylinder (20) comprises a cylinder body (40) connected to a compressor body (26), the cylinder body (40) having a chamber (43) in which the connecting rod (16) moves, the chamber communicates with a cavity (5) inside a casing (2) of the motor-driven compressor (1) by means of a duct (13A) provided longitudinally in the drive shaft (13) and connected to a pipe (13C) extending into a lower region (5A) of the cavity (5) inside the casing (2).

5. A motor-driven compressor according to claim 4, wherein a duct (44) in the crank is connected to the duct (13A) in the drive shaft (13) and communicates with the seat (29) in which the ball-and-socket joint (19) associated with the small end of the connecting rod (16A) is disposed.

6. A motor-driven compressor according to claim 4, wherein the cylinder body (40) has a flanged end (41) associated with the compressor body (26).

7. A motor-driven compressor according to claim 6, wherein the compressor body (26) is cup-shaped and has a lateral wall (56) which houses a portion (8A) of the electric actuator (8), the wall (56) cooperating, by means of threaded connection elements (55) disposed beside the actuator (8), with a support member (6) disposed below the actuator (8).

8. A motor-driven compressor according to claim 1, wherein the crank (15A) moves on a mechanical coupling member (21) disposed in a respective seat (26A) in the compressor body (26).

* * * * *